US005345881A

United States Patent [19]

Loescher

[11] Patent Number: 5,345,881

[45] Date of Patent: Sep. 13, 1994

[54] FOLDING TABLE MECHANISM

[75] Inventor: William A. Loescher, Redding, Conn.

[73] Assignee: Howe Furniture Corporation, Trumbull, Conn.

[21] Appl. No.: 810,515

[22] Filed: Dec. 19, 1991

[51] Int. Cl.[5] ..... A47B 3/00

[52] U.S. Cl. ..... 108/132; 108/131

[58] Field of Search ..... 108/64, 129, 131, 132

[56] References Cited

U.S. PATENT DOCUMENTS

| | | | |
|---|---|---|---|
| 3,818,844 | 6/1974 | Burr | 108/132 |
| 3,991,687 | 11/1976 | Burr | 108/132 |
| 4,444,124 | 4/1984 | Burr | 108/132 |
| 4,978,168 | 12/1990 | Piretti | 108/64 |

*Primary Examiner*—Kenneth J. Dorner
*Assistant Examiner*—Gerald Anderson
*Attorney, Agent, or Firm*—Parmelee, Bollinger & Bramblett

[57] ABSTRACT

An exceptionally rigid and compact folding mechanism for a table employs hollow rail members which support the mechanism therebetween. A pair of legs are mounted to the ends of a stretcher member to form a folding unit. This unit is translationally and rotationally connected to the rail members by an over center cam mechanism operated by a lock bar. The lock bar bends to exert locking force in both the unfolded and folded positions of the table legs.

8 Claims, 4 Drawing Sheets

FOLDING TABLE MECHANISM

TECHNICAL FIELD

This invention pertains to the field of leg folding mechanisms for tables. More particularly, it pertains to such mechanisms having less slack, more rigidity, and being less visible than prior art mechanisms.

BACKGROUND ART

Tables with folding legs are, of course, well known in the art. There has been a continuing effort to provide such tables which, when erected, have the rigidity of conventional tables. One way of achieving increased rigidity is to reduce the number of the folding legs to two by making them in an inverted "T" shape, thereby reducing the number of folding machanisms required.

Another method for increasing the rigidity of such a table is to utilize a trestle bar which connects the two legs. An example of such a construction may be found in U.S. Pat. No. 4,444,124 of Burr, which issued Apr. 24, 1984 and was assigned to the same assignee as the present invention.

An earlier such patent is U.S. Pat. No. 3,818,844 which issued Jun. 25, 1974. The table described in that patent includes a trestle bar connecting the two table legs and a stretcher bar extending in the same general direction as the trestle bar. Pins project outwardly from both ends of the stretcher bar. Means are provided to enable each table leg to be unfolded through an arc of more than 90° relative to the underside of the table top. Many users, however, desire the increased stability of a table having the conventional four legs.

DISCLOSURE OF INVENTION

The present invention comprises a folding table which has hollow rectangular side rails. The inner walls of the side rails support the folding mechanism. The outer walls hide the mechanism from view. At each end of the table is a pair of folding legs connected to a stretcher member. Each of the stretcher and leg pair assemblies is pivotally connected to the side rails by means of a past-center cam mechanism. When the legs are extended, the cam mechanism holds the upper ends of the legs firmly against the ends of the side rails. When the legs are folded, the same mechanism prevents the legs from being unfolded. The cam mechanism is controlled by a lock bar which bends and thereby maintains pressure between the leg assembly and the rails in both the folded and extended positions of the legs.

BEST MODE FOR CARRYING OUT THE INVENTION

In accordance with the present invention, a pair of legs at each end of the table operate as a unit. The folding mechanism for one pair of legs is identical to the folding mechanism of the opposite pair of legs. (There is one exception to this in the case of short tables which will be explained below in connection with the illustration of FIG. 9.) Each set of legs employs a folding mechanism adjacent to each leg. These mechanisms are identical but are mirror images of one another. Accordingly, only one will be described in detail.

Figure 1:
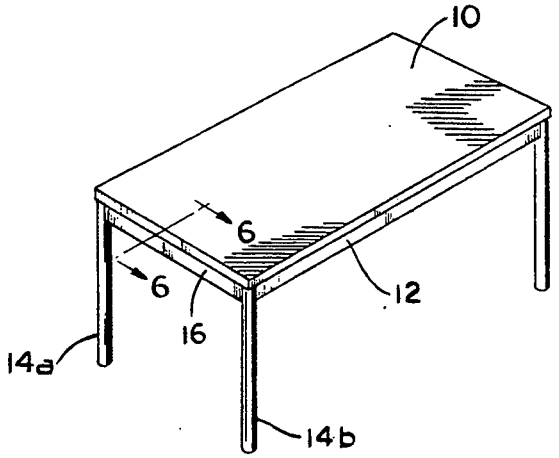
FIG. 1 is a perspective view of a rectangular folding table in accordance with the present invention.
Figure 2:
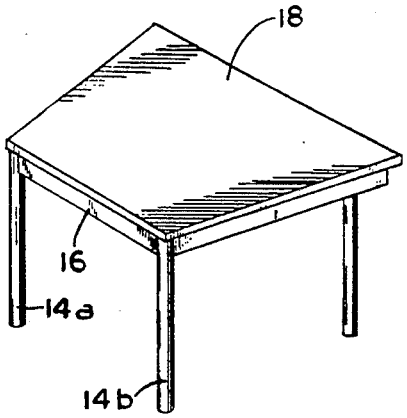
FIG. 2 is a perspective view of a trapezoidal folding table in accordance with the present invention.

FIG. 1 illustrates a table in accordance with the present invention comprising a rectangular top 10, a pair of parallel side rails 12 (only one being visible) mounted to the under side of the top 10 and a pair of folding legs **14*a*, 14*b* at each end of the table joined by a stretcher 16. FIG. 2 illustrates a table having a similar pair of folding legs 14*a*, 14*b* joined by a stretcher 16. However, the table of FIG. 2 has a trapezoidal top 18** and the rails are not visible, as will be explained below. As used herein, the term "rail" is to be understood as meaning the parallel members which support the opposed folding mechanisms for each pair of folding legs. One of the advantages of the folding mechanism of this invention is that it may be used for legs of either round or rectangular cross section. This is achieved by the use of leg plugs as will be explained below. The folding mechanism now to be described is for legs of circular cross section.

Figure 7:
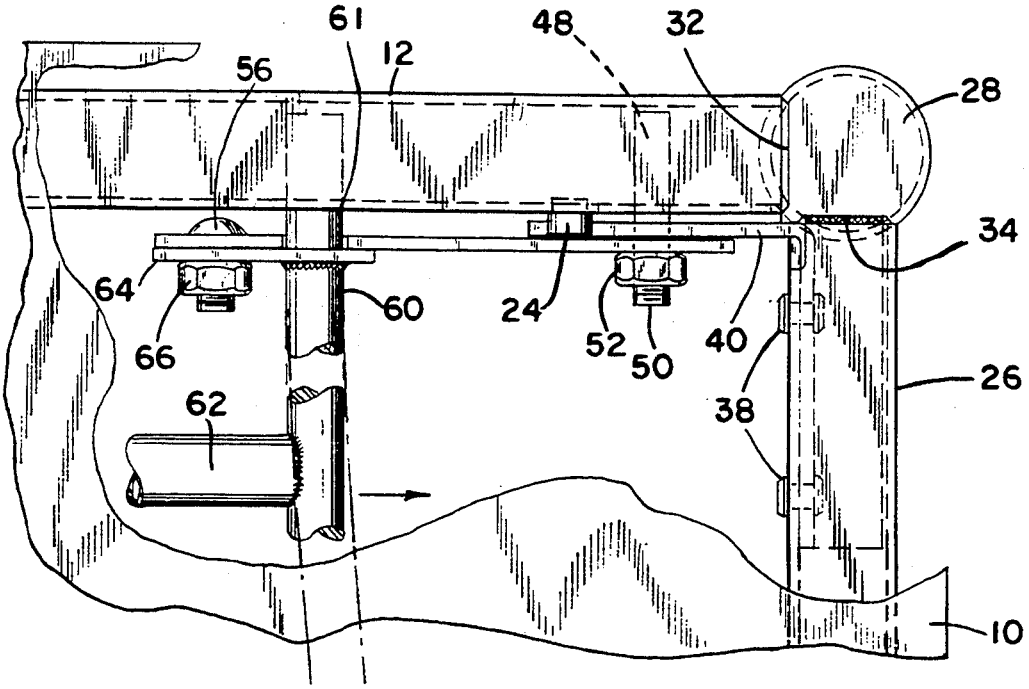
FIG. 7 is a plan view of the mechanism of FIG. 6 with a portion of the table top broken away.
Figure 6:
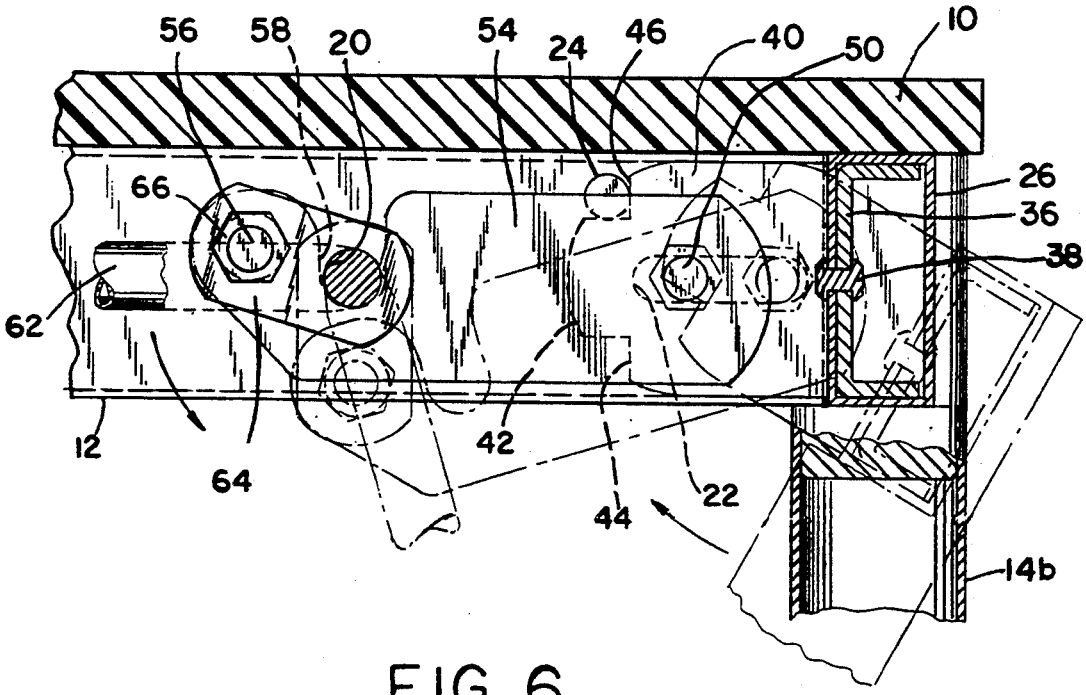
FIG. 6 is an enlarged detail, taken substantially along the line 6—6 of FIG. 1, illustrating the folding mechanism of this invention in elevation.

Turning now to FIGS. 6 and 7, there is illustrated a side rail 12 which is secured by suitable means such as screws (not shown) to the under side of a table top 10. The height of the rail 12 is preferably sufficient to hide the folding mechanism when the table legs are extended. In the rectangular table now being described, the side rail 12 extends substantially the length of the table and carries similar but opposed folding mechanisms at each end, as does the mirror image rail on the opposite side of the table top.

Figure 3:
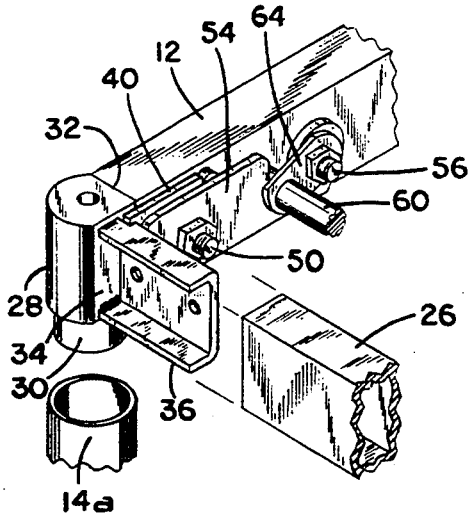
FIG. 3 is an enlarged detail, partially broken away, illustrating a portion of the folding mechanism of the table of FIG. 1.

The inner wall of each side rail 12 includes a round bearing hole 20 and a slot 22 near its end, both located substantially on the longitudinal centerline of the rail as shown in FIG. 6. Welded to the inner wall of the side rail 12 and near the upper edge of the rail is a cylindrical stud 24. The folding leg assembly at each end of the table comprises a stretcher 26 in the form of a rectangular tube substantially similar to the side rail 12. Each end of the stretcher 26 is connected to a different one of the legs **14*a*, 14*b*. Each leg, as illustrated, is a hollow circular tube and carries within its upper end a plug 28. As illustrated in FIG. 3, plug 28 includes a small diameter neck 30 which is secured within the upper end of the leg 14*a*. The upper portion of plug 28 has one flat surface 32** aligned with the end of the side rail 12 and another flat surface 34 on the inside of the leg plug to which is welded a C bracket 36. The C bracket 36 extends into the open end of the stretcher 26 to which it is secured by suitable means such as rivets 38.

The major vertical face of the C bracket 36 is bent inwardly at right angles to form a leg bracket 40. The leg bracket 40 lies alongside and closely adjacent its corresponding side rail 12 when the legs are in their extended position. As will be seen by reference to FIG. 6, the end 42 of the bracket is curved but carries on its lower surface a clearance notch 44. Symmetrically positioned along its upper surface is a leg block-down notch 46.

Carried by the leg bracket 40 is a stud 48 which extends through the slot 22 in the side rail 12, its opposite end 50 being threaded. Loosely retained on the end of the stud 48 by a nut 52 is one end of a hook link 54. The opposite end of the hook link 54 carries a short bolt 56 adjacent a hook-shaped recess 58.

Extending between the bearing hole 20 in the side rail 12 and the similar hole in the opposing side rail is a steel lock bar 60. A perpendicular handle 62 is welded to the bar 60 at substantially its midpoint. Each end of the lock bar 60 carries a cam link 64 which is welded thereto. The cam link 64 is pivotally secured to the bolt 56 by means of a nut 66. In the solid line illustrations of FIGS. 6 and 7, the mechanism is shown with the legs in their unfolded and locked position wherein the flat surface 32 of the leg plug 28 is pulled tightly against the end of the side rail 12.

Figure 8:
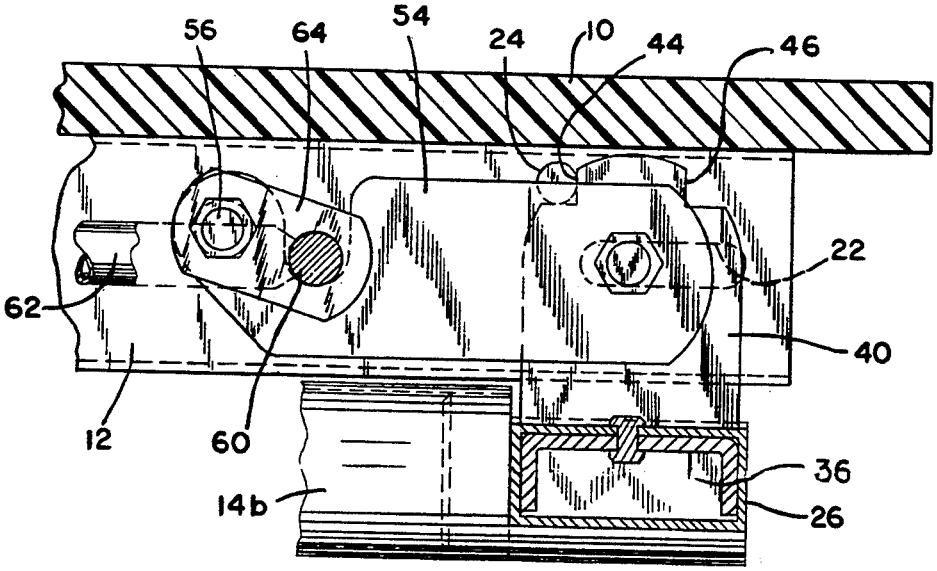
FIG. 8 is a view similar to FIG. 6 illustrating the mechanism with the legs in their folded positions.

When it is desired to release and fold the legs, the handle 62 is pulled downward as indicated by the arrow in FIG. 6. This causes the cam link 64 at each side of the table to rotate counterclockwise, as indicated by the showing in dash-dot lines. This releases all tension on the hook link 54 and also releases tension on the leg bracket 40. The leg and stretcher 26 assembly is then moved outwardly by means of the stud 48 sliding to the right end (as viewed in FIG. 6) of slot 22. This permits the leg and stretcher assembly to be rotated clockwise as illustrated by the arrow in FIG. 6 into the folded position illustrated in FIG. 8 wherein the legs 14 lie parallel to the table top 10.

The legs are locked into their folding position by returning the handle 62 to its horizontal position. This causes the cam links 64 to be rotated clockwise. It is important to note from the illustrations of FIGS. 6 and 8 that, when handle 62 is horizontal, the bolt 56 is positioned above the axis of rotation of the lock bar 60. As a result, upon the handle 62 returning to its horizontal position, the cam link 64 is caused to pass center. This creates significant tension on hook link 54, pulling its clearance notch 44 into engagement with the stud 24 and assures a positive locking action. As the cams rotate past center, the tension of hook link 54 pulls the lock bar 60 against a fulcrum 61. This causes the steel lock bar 60 to bend as shown by the dashed-dotted lines and thereby maintains compression between the leg assembly and the stud 24 seated in the clearance notch 44.

When the table is unfolded, the operation is reversed. The handle 62 is pulled downward from the table top, causing the cam links 64 to carry the bolts 56 past center, releasing the tension on hook links 54. This permits the leg assembly to be rotated into its upright position as illustrated in FIG. 6. When the handle 62 is then returned to its horizontal position, cam links 64 once again pass center. The leg block-down notch 46 seats against the stud 24 and the leg assembly is pulled inwardly with substantial force.

It is important to note the function of the leg plugs 28. As these are substantially solid, they are able to withstand the compressive force with which they are urged against the end of the side rails 12. Exceptional rigidity of the unfolded table is obtained by welding the leg brackets 40 to the plugs 28, rather than to the legs. Thus, by the use of leg plugs, the legs themselves may be of relatively light weight.

Figure 5:
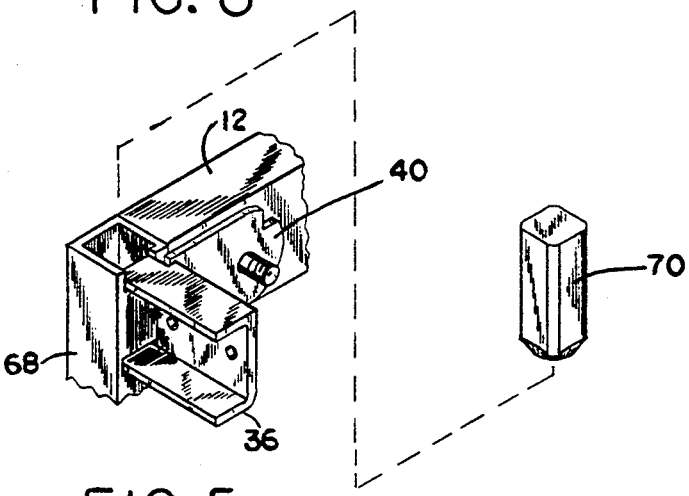
FIG. 5 is an enlarged detail illustrating a modification of the invention for tables having legs of square or rectangular cross section.

In the foregoing description, a structure was described wherein the table legs were round and each carried a plug extension having flat surfaces. A modification is illustrated in FIG. 5 which employs a table leg 68 of square cross section. In this embodiment, the end of the leg itself bears against the end of the side rail 12. A square plug 70 is inserted into the end of the leg 68 to take the compressive force. The end of the C bracket 36 is welded to the plug 70 through notches cut into the leg 68.

Figure 4:
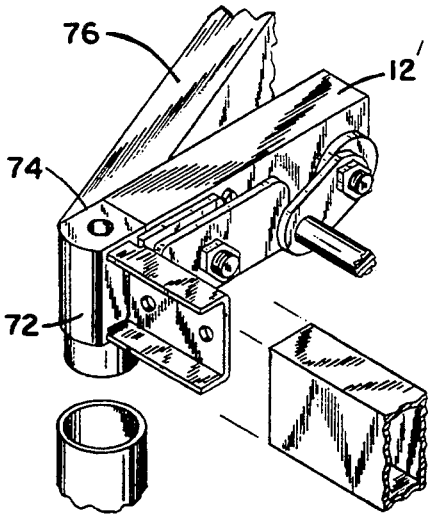
FIG. 4 is an enlarged detail, partially broken away, of the folding mechanism of the table of FIG. 2.

Another modification is illustrated in FIG. 4. This illustrates the manner in which the mechanism may be adapted to non-rectangular tables. In this modification, plug 72 has another flat surface 74 to support the end of a table top support member 76 which does not function as a part of the folding and locking mechanism. In this arrangement, there is provided a modified rail 12' which does not extend the length of the table but merely serves to anchor the ends of the locking mechanism.

Figure 9:
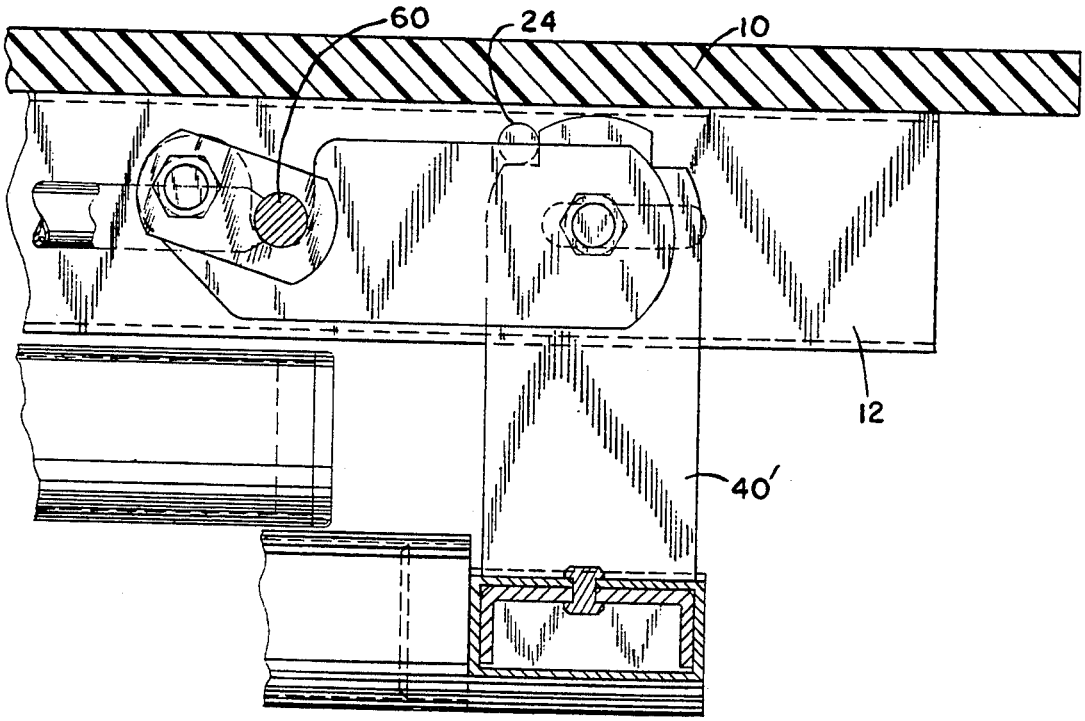
FIG. 9 is a view similar to FIG. 8 illustrating a modification for use with small tables.

A further modification is illustrated in FIG. 9. In this modification, the table is too short to permit the folded legs to lie in the same plane. Accordingly, the leg brackets 40' at one end are lengthened to permit the legs to nest as illustrated. In all other respects, the mechanism of FIG. 9 is the same as previously described.

Figure 13:
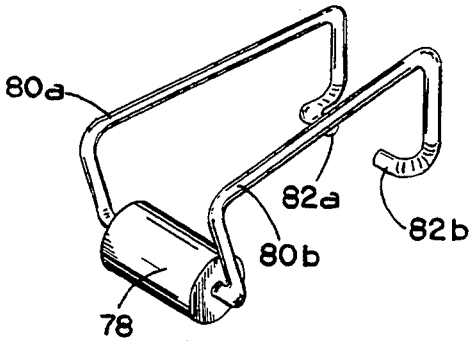
FIG. 13 is a perspective view of the ganging clamp of FIGS. 10–12.

A further feature of this invention is the provision of ganging clamps carried on the under sides of the table tops to permit tables being joined. FIG. 13 illustrates a ganging clamp which comprises a roller 78 mounted at the center of a bent wire spring forming a pair of U-shaped hooks **80*a*, 80*b* having opposed inwardly turned ends 82*a*, 82*b*. As will be clear from FIG. 13, the major arms of the hooks 80*a*, 80*b* are not exactly parallel but converge as they extend away from the roller 78**.

Figure 10:
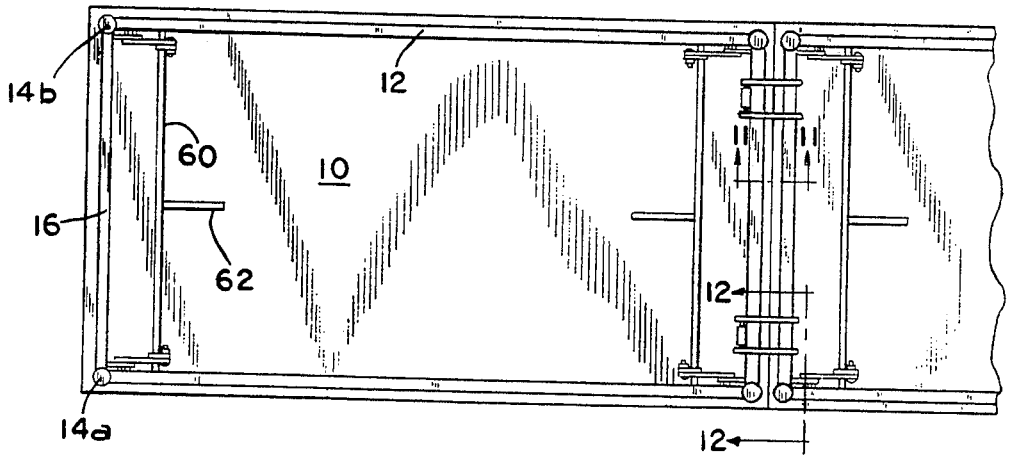
FIG. 10 is a bottom view illustrating two tables in accordance with the invention ganged together.
Figure 11:
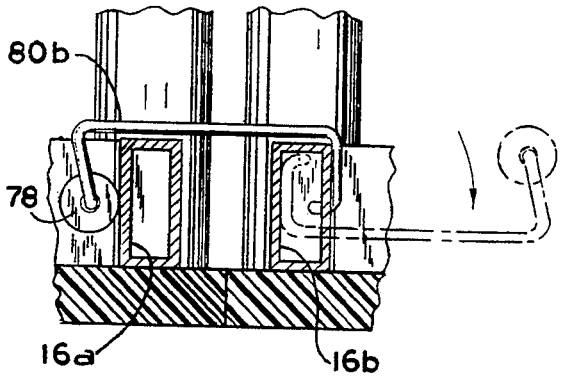
FIG. 11 is an enlarged cross section taken substantially along the line 11—11 of FIG. 10.
Figure 12:
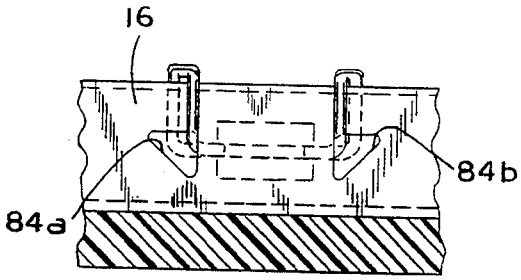
FIG. 12 is an enlarged cross section taken substantially along the line 12—12 of FIG. 10.

As illustrated in FIG. 12, the inner walls of the side rails 12 and stretchers 16 carry spaced triangular openings **84*a*, 84*b*. The ganging clamp illustrated in FIG. 13 is mounted into a pair of the triangular openings by spreading the ends 82*a*, 82*b* to permit them to pass through the triangular openings. Upon release their natural spring action causes them to engage the inner sides of the openings. As illustrated in FIG. 11, a ganging clamp in the stretcher 16*b* of one table may be used to engage the stretcher 16*a* of an abutting table. When engaged with an adjoining table, the resilient hooks 80*a*, *b* are forced apart into the horizontal configuration shown in FIG. 10, with the ends 82*a*, *b* in the outer corners of the triangular openings 84*a*, *b***. If desired, however, the ganging clamp can be rotated as illustrated by the arrow to disengage and be stored beneath the table top out of sight.

One of the features of this invention is that the entire folding mechanism is hidden by the rails and stretchers when the table is in use. This is a result of the use of hollow side rails and stretchers having sufficient height to cover the exceptionally compact folding mechanism.

It is believed that the many advantages of this invention will now be apparent to those skilled in the art. It will also be apparent that a number of variations and modifications may be made therein without departing from its spirit and scope. Accordingly, the foregoing description is to be construed as illustrative only, rather than limiting. This invention is limited only by the scope of the following claims.

I claim:

1. A locking mechanism for the legs of a folding table having a top side and an underneath side, first and second parallel spaced rails on the underneath side of said top, at least two legs, each mounted to a different end of a stretcher member whereby said legs are positioned abutting the respective ends of said first and second rails when in their unfolded and locked condition, comprising:

first and second leg brackets secured, respectively, to each end of said stretcher member and extending substantially parallel and adjacent to the respective first and second rails;

means interconnecting each of said first and second leg brackets with its respective first and second rail for permitting rotational and translational motion therebetween;

a lock bar extending between said spaced first and second rails parallel to said stretcher member and rotatable about its longitudinal axis;

a cam link secured to each end of said lock bar for rotation therewith;

a first hook link having a first end rotatably connected to one of said interconnecting means and a second end;

a second hook link having a first end rotatably connected to the other one of said interconnecting means and a second end;

means for pivotally interconnecting the second end of said first hook link with one of said cam links;

means for pivotally interconnecting the second end of said second hook link with the other one of said cam links; and means for rotating said lock bar to permit rotation and translation of said interconnecting means between over center locking positions securing said legs and stretcher member in either of (1) a folded or extended position and (2) a release position.

2. The improvement of claim 1 wherein said interconnecting means comprises a slot in one of said leg brackets and rail and a stud carried by the other of said leg brackets and rail.

3. The improvement of claim 2 wherein said slot is in said rail and said stud is carried by said leg bracket.

4. The improvement of claim 1 wherein each of said legs, when in its extended position, is pulled against the end of its corresponding rail.

5. The improvement of claim 4 wherein said leg is hollow and carries a plug member for compression against the end of said rail.

6. The improvement of claim 5 wherein said plug member includes a substantially flat surface for engagement with the end of said rail.

7. The improvement of claim 6 wherein said leg is substantially circular in cross section.

8. The improvement of claim 1 wherein said table top is substantially rectangular and said rails extend substantially the length of said table.

* * * * *